United States Patent [19]

Preisetanz et al.

[11] Patent Number: 5,012,594

[45] Date of Patent: May 7, 1991

[54] WEB DRYING UNIT

[75] Inventors: Johann Preisetanz, Heidenheim; Gerhard Kotitschke, Steinheim, both of Fed. Rep. of Germany

[73] Assignee: J. M. Voith GmbH, Heidenheim, Fed. Rep. of Germany

[21] Appl. No.: 435,195

[22] Filed: Nov. 13, 1989

[30] Foreign Application Priority Data

Nov. 11, 1988 [DE] Fed. Rep. of Germany ..... 8814118

[51] Int. Cl.[5] ..... F26B 11/02

[52] U.S. Cl. ..... 34/121; 74/665 A; 34/123

[58] Field of Search ..... 34/121, 123, 116; 74/665 A

[56] References Cited

U.S. PATENT DOCUMENTS

| | | | |
|---|---|---|---|
| 4,181,039 | 1/1980 | Phelps | 74/665 GA |
| 4,495,711 | 1/1985 | Justus | 34/23 |
| 4,495,712 | 1/1985 | Justus | 34/52 |
| 4,908,958 | 3/1990 | Sollinger et al. | 34/121 |

FOREIGN PATENT DOCUMENTS 3643725 6/1988 Fed. Rep. of Germany .

*Primary Examiner*—Henry A. Bennet

*Attorney, Agent, or Firm*—Jeffers, Hoffman & Niewyk

[57] ABSTRACT

A web drying unit, e.g. for a paper making machine, has several drying cylinders, over which a web to be dried can pass, and also several guide rolls for at least one endless supporting belt for pressing the web to be dried against the drying cylinders. Only some of the drying cylinders are provided with a drive gear connected by gears to a drive pinion, the gears being disposed inside a gear housing, which is also used to house cylinder journal pins for the drive motor. At least one of the guide rolls is also provided with a drive gear, which is connected to a drive gear of the drying cylinder. A gear housing also contains the drive gear of the guide roller and its bearing on the drive side. Only one common drive is needed for the unit, and uniform ventilation conditions are enabled to occur over the cross-direction of the paper web. To ensure no obstruction to maintenance personnel on the drive side of the unit, the drive pinion is disposed in the upper region of the gear housing.

4 Claims, 2 Drawing Sheets

WEB DRYING UNIT

BACKGROUND OF THE INVENTION

The invention relates to a web drying unit, for a paper making machine, for example.

As known, the drying section of a paper making machine is divided into several drying units. It is customary for at least one drive motor to be provided for each drying unit, which motor usually drives via gear wheels several drying cylinders over which the web can pass.

It is also known to provide a geared motor for each drying cylinder, or for some individual drying cylinders, or to drive only some individual guide rolls of a supporting belt for pressing the web against the drying cylinders. In the latter case those drying cylinders which are not connected by gearing to the drive are driven via the supporting belt.

Some disadvantages of the known drives include the following:

(a) The frames on the front side and the drive side of the unit are not identical; consequently, irregular ventilation conditions occur, which result in an effect on the profile of paper dryness in the cross-machine direction;

(b) The drive motor and associated universal-joint shaft are normally located in a region at body height and result in an obstruction to maintenance personnel along the drive side;

(c) Separate drives are required for cylinders and guide rolls, which is cost-intensive.

SUMMARY OF THE INVENTION

The object of the invention is to create a drive for a web drying unit which avoids the disadvantages of the known constructions and in particular, which can be manufactured with low expenditure. Conveniently, such a drive should also have the facility for the drive motor to be disposed at a relatively great height above the machine floor, so that maintenance personnel can move without hindrance along the drive side of the drying unit. This object is achieved by the features of the present invention.

The primary advantages of the invention are as follows:

(a) A predominantly open frame on the drive side identical to the frame on the front side; consequently, uniform ventilation conditions occur and there is no resultant effect on the profile of paper dryness in the cross-machine direction;

(b) No obstruction to maintenance personnel on the drive side by drives;

(c) Only one common drive is needed for the drive cylinders and guide rolls, which is cost-favorable.

BRIEF DESCRIPTION OF THE DRAWINGS

An exemplified embodiment is described below with reference to the accompanying drawings.

DESCRIPTION OF THE PREFERRED EMBODIMENT

Figure 1:
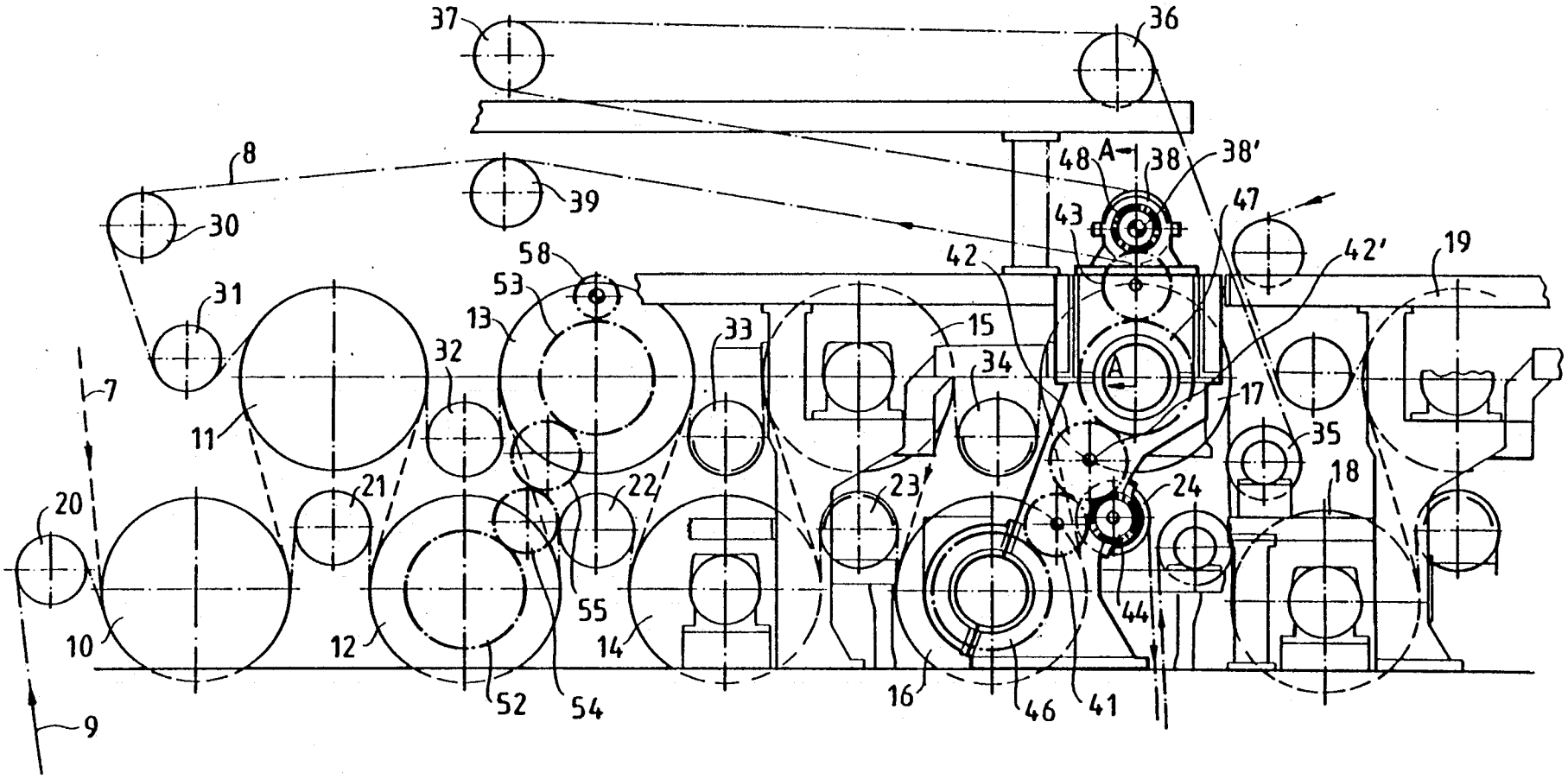
FIG. 1 diagrammatically shows a web drying unit for a paper making machine in lateral view.

FIG. 1 shows a drying unit with eight drying cylinders 10 to 17 (and cylinders 18 and 19 belonging to a subsequent drying unit). The drying unit has four lower cylinders 10, 12, 14 and 16, and appertaining thereto several lower guide rolls 20 to 24 for a lower supporting belt 9 for pressing the paper web 7 to be dried against said lower cylinders. There are also four upper cylinders 11, 13, 15 and 17, and appertaining thereto several upper guide rolls 30 to 39 for an upper supporting belt 8 for pressing said web 7 against said upper cylinders.

In one embodiment of the invention, out of all the cylinders, only cylinders 16 and 17 have a drive gear 46 and 47 respectively; these are connected to one another by intermediate gear wheels 41 and 42, and also to a drive gear 44 which drives lower guide roll 24. The drive gear 47 of the upper drying cylinder 17 also meshes with an intermediate gear wheel 43 which, in turn, meshes with a drive pinion 48 attached to upper guide roll 38. This guide roll 38 has an extended journal pin 38', which is symbolically represented and to which a drive motor (not shown) can be connected, for example by means of a universal joint shaft (not shown).

In a further exemplified embodiment of the invention, the intermediate gear wheel 42 (instead of guide roll 38) can be equipped with an extended journal pin 42', for the purpose of coupling the drive motor (not shown). In a further refinement, the lower guide roll 24 could also be provided with such an extended journal pin.

In a third exemplified embodiment of the invention, two further drying cylinders, namely cylinders 12 and 13, may also be provided with a drive unit (drive gears 52 and 53, intermediate gear wheels 54 and 55 and drive pinion 58).

Figure 2:
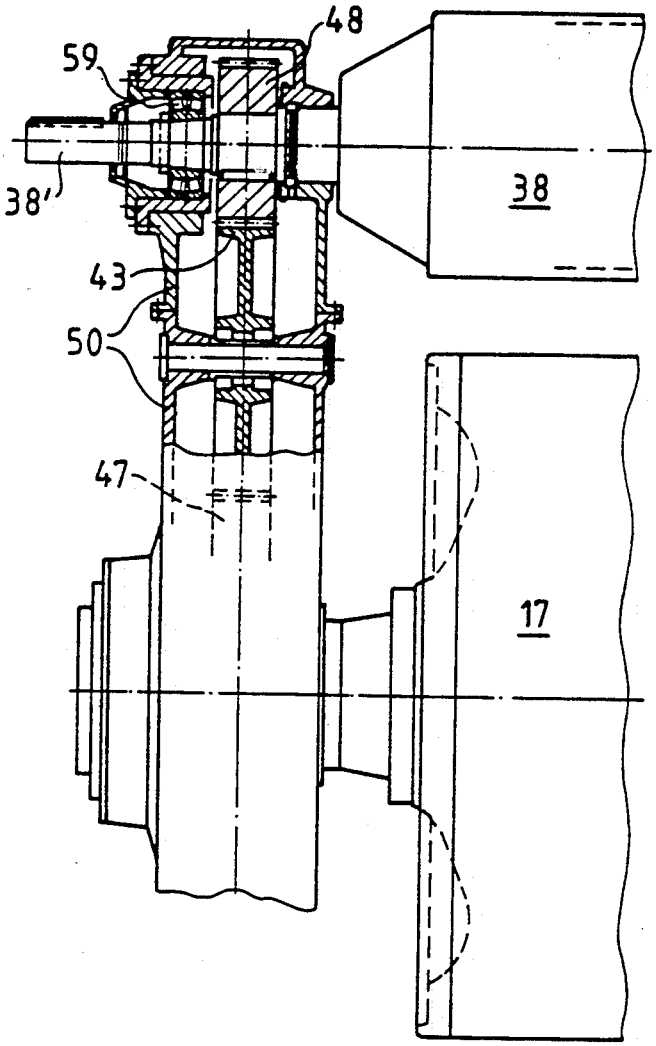
FIG. 2 is a partial cross-section along line A—A of FIG. 1.

FIG. 2 shows the driven guide roll 38 and the drying cylinder 17 disposed underneath it. Also, as shown, the guide roll has the extended journal pin 38' for coupling to a motor (not shown), which pin is supported in a bearing 59.

The pin 38' has the drive pinion 48 keyed to it which drives the cylinder 17 through intermediate gear wheel 43 and the drive gear wheel 47. It will also be seen that a gear housing 50 encloses all the gear wheels. In FIG. 1 this housing is defined by the relatively thick solid lines.

What is claimed is:

1. A drive for a drying group of a paper-making machine, wherein said drying group comprises:

several drying cylinders across which a web to be dried can run, said drying group including an upper row of cylinders with an upper backing belt and a lower row of cylinders with a lower backing belt, wherein only some of the drying cylinders are provided with a drive gear, said only some drying cylinders including a cylinder in said upper row of cylinders and an adjacent cylinder in said lower row of cylinders, said drive gears being in drive connection with a drive journal, the drive journal being connected to means for driving said journal;

several guide rolls for said backing belts for forcing said web against said drying cylinders, at least one of said guide rolls being in drive connection with said drive journal, wherein a guide roll for said upper backing belt and a guide roll for said lower backing belt are each provided with a drive gear;

wherein said drive gears of the guide rolls are combined with the drive gear of said cylinder in the upper row of cylinders and the drive gear of said adjacent cylinder in the lower row of cylinders in a common gear case to form a single gear set, said gear case further supporting said driven journal and said driven guide rolls.

2. The drive for a drying group as described in claim 1, wherein said drive journal is arranged in an upper area of said gear case.

3. The drive for a drying group as described in claim 1, in which one of the drive gears associated with a guide roll is fashioned as said drive journal.

4. The drive for a drying group as described in claim 2, in which one of the drive gears associated with a guide roll is fashioned as said drive journal.

* * * * *